US010004300B2

(12) United States Patent
Waller et al.

(10) Patent No.: US 10,004,300 B2
(45) Date of Patent: Jun. 26, 2018

(54) STRAP

(75) Inventors: Tom Waller, Nottingham (GB); Chris Johnson, Nottingham (GB)

(73) Assignee: SPEEDO INTERNATIONAL LIMITED, London (GB)

( * ) Notice: Subject to any disclaimer, the term of this patent is extended or adjusted under 35 U.S.C. 154(b) by 1112 days.

(21) Appl. No.: 13/486,545

(22) Filed: Jun. 1, 2012

(65) Prior Publication Data

US 2012/0304368 A1 Dec. 6, 2012

(30) Foreign Application Priority Data

Jun. 3, 2011 (GB) ..... 1109402.6

(51) Int. Cl.
*A44B 11/04* (2006.01)
*A63B 33/00* (2006.01)
*A63B 31/08* (2006.01)

(52) U.S. Cl.
CPC ..... *A44B 11/04* (2013.01); *A63B 33/00* (2013.01); *A63B 33/002* (2013.01); *A63B 31/08* (2013.01); *A63B 2225/09* (2013.01)

(58) Field of Classification Search
CPC ..... A44B 11/006; A44B 11/04; A44B 11/02; A44B 11/18; A44B 11/065; A45F 2003/142; A45F 3/14; Y10T 24/4745; Y10T 24/4736; Y10T 24/47; Y10T 24/1498; Y10T 24/1406; Y10T 24/318; Y10T 24/4791; Y10T 24/4782; Y10T 24/4764; Y10T 24/4773; Y10T 24/4727; Y10T 24/316; Y10T 24/314; Y10T 24/4093; Y10T 24/2164; Y10T 24/4088;
(Continued)

(56) References Cited

U.S. PATENT DOCUMENTS 4,922,582 A * 5/1990 Flanigan ..... A44B 11/065 24/71.1
5,245,731 A * 9/1993 Funathu ..... A44B 11/04 24/200

(Continued)

FOREIGN PATENT DOCUMENTS

CH 476473 A * 11/1968 ..... A44B 11/04
GB 435268 9/1936

(Continued)

OTHER PUBLICATIONS

Taiwanese Office Action, Application No. 05159/10520325390, dated Mar. 17, 2016, 16 pages.

(Continued)

*Primary Examiner* — Jack W Lavinder
(74) *Attorney, Agent, or Firm* — Marvin Petry; Stites & Harbison PLLC

(57) ABSTRACT

The present invention provides a strap for securing a garment/article (e.g. swimming goggles) to a wearer's/user's body. The strap comprises a first portion comprising a tensioner end including a tensioner having an attachment portion. The attachment portion is for attachment to the tensioner end. The strap further comprises a second portion having indicia provided along at least a part of its length. In use, the second portion passes through the tensioner and the tensioner frame defines a window in which at least one of the indicia on the second portion is visible.

15 Claims, 4 Drawing Sheets

(58) Field of Classification Search
CPC . A63B 2033/004; A63B 33/002; A61F 9/027; A45C 13/26
USPC ..... 285/420, 134.1; 2/452, 426
See application file for complete search history.

(56) References Cited

U.S. PATENT DOCUMENTS

| | | | | |
|---|---|---|---|---|
| 5,706,526 | A * | 1/1998 | Huang | A63B 33/002 2/428 |
| 5,727,259 | A * | 3/1998 | Kawamata | 2/452 |
| 5,732,415 | A * | 3/1998 | Boyd | A61D 9/00 119/836 |
| 6,119,279 | A * | 9/2000 | Haslbeck | A63B 33/002 2/428 |
| 6,351,874 | B1 * | 3/2002 | Suggs | 24/265 BC |
| 7,356,885 | B2 | 4/2008 | Tomasetti et al. | |
| 7,805,816 | B1 * | 10/2010 | Thorne, III | B60P 7/0807 24/265 H |
| 8,058,540 | B2 | 11/2011 | Furuta et al. | |
| 2006/0026804 | A1 | 2/2006 | Lee | |
| 2007/0209164 | A1 * | 9/2007 | Tomasetti et al. | 24/16 PB |
| 2008/0244875 | A1 | 10/2008 | Chou | |
| 2009/0165192 | A1 | 7/2009 | Chiang | |

FOREIGN PATENT DOCUMENTS

| | | |
|---|---|---|
| GB | 2461691 | 1/2010 |
| JP | 47-37703 | 11/1972 |
| JP | 3045899 | 11/1997 |
| JP | U 11981074020 | 11/2000 |
| JP | 2001-333804 | 12/2001 |
| JP | 3166397 | 12/2010 |
| KR | 20-0430844 | 1/2006 |
| SU | 55523 | 8/1939 |
| TW | M 342188 | 10/2008 |
| WO | WO 94/19085 | 9/1994 |
| WO | WO 2007/034223 | 3/2007 |

OTHER PUBLICATIONS

International Search Report, International Application No. PCT/GB2012/051246, International Filing Date: Jun. 1, 2012, 5 pages.
Written Opinion of the International Searching Authority, International Application No. PCT/GB2012/051246, International Filing Date: Jun. 1 2012, 5 pages.
Chinese Office Action, Application No. 201280000440.6, dated Sep. 23, 2015, 5 pages.
The Korean Intellectual Property Office, Notification of Preliminary Relection, Application No. 10-2012-7017259, dated Nov. 7, 2013.
Japanese Office Action, Application No. 2012-126797, dated Nov. 27, 2012.
Russian Decision on Grant, Receipt date of Decision on Grant: Aug. 1, 2017, Application No. 2012122740/12(034586), Application filing date: Jun. 1, 2012, 14 pages.

* cited by examiner

STRAP

FIELD OF THE INVENTION

This invention relates to a strap. In particular, this invention relates to a strap (or belt) which is useful for securing a garment (e.g. sportswear) or an article (e.g. a sporting article such as hand paddles or kick fins) to a wearer's/user's body. Particularly preferred embodiments relate to a head strap for eyewear such as eyewear for safety and/or sporting purposes.

BACKGROUND

It is often desirable to secure eyewear to a wearer's head to avoid loss or movement of the eyewear. For eyewear (e.g. a goggle or mask) which is worn in sporting activities such as swimming or skiing, it is especially important to secure the eyewear to the wearer's face and elastic head straps are typically used for this purpose.

Ideally these head straps need to be adjustable to cater for a range of head sizes and to allow the wearer to select their desired strap tension. One way of achieving this adjustability has been to provide a buckle through which the strap passes, the fee end of the strap being pulled to tighten the head strap once the eyewear is in place.

Once the strap is tightened, it can be difficult to readjust the tension in the strap for several reasons. Firstly, it is more difficult to loosen the head strap than it is to tighten it and it may be necessary to remove the eyewear in order to loosen the head strap. Secondly, if the wearer is participating in competitive sporting activities, it may only become apparent that the head strap is incorrectly adjusted once the competitive activity has commenced by which time it will be too late to make any further adjustments. For this reason, it is desirable to provide some means for allowing a reliable and accurate measurement of tension within the head strap so that the wearer can ensure that the head strap is correctly adjusted.

Another problem with the known buckle adjustment arrangements is that the free end can cause a discomfort and distraction by flapping around when the eyewear is in place.

Furthermore, the buckle can protrude significantly from the back of the head when the eyewear is being worn. This can cause discomfort especially if a tight fitting hat or cap is worn over the top of the strap. Furthermore, in the case of swimming goggles, the protrusion of the buckle can create frictional drag (whether or not the buckle is covered by a swimming cap) and this is undesirable.

SUMMARY OF THE INVENTION

In a first aspect, the present invention provides a strap for securing a sporting garment or article to a wearer's/user's body, the strap comprising a tensioner and a portion having indicia provided along at least a part of its length, wherein, in use, the portion having indicia passes through the tensioner, the tensioner comprising a frame defining a window in which at least one of said indicia on the strap portion is visible.

By providing indicia on a portion of the strap, it is possible to reliably reproduce a desired tension in the strap. For example, the wearer can fit the strap to the desired tension and then can observe the indicium framed by the tensioner window at the desired tension. The wearer then knows that, in order to recreate the desired tension, they can set the strap so that the same indicium is framed by the tensioner window.

The indicia may be visible and or tactile indicia. The indicia may be numerical indicia.

Preferably, the strap includes an indicator which helps to accurately position the desired indicium in the tensioner window. The indicator may be provided on the tensioner. It may be raised from, recessed into or printed onto the surface of the tensioner. By providing an indicator, the wearer can more accurately determine the required location of the desired indicium in the tensioner window.

The indicator may be a linear or arrow-shaped element. This increases the accuracy of the determination of the required location of the desired indicium even further since the linear element or apex of the arrow-shaped element can be used to indicate a precise location for reading the desired indicium at the desired strap tension and also provides a precise location for positioning the desired indicium to re-create the desired strap tension.

In a second aspect, the present invention provides a strap for securing a garment/article (e.g. a sporting garment/article) to a wearer's/user's body, the strap comprising a first portion comprising a tensioner end including a tensioner having an attachment portion, the attachment portion being for attachment to said tensioner end, and a second portion having indicia provided along at least a part of its length, wherein, in use, the second portion passes through the tensioner, the tensioner comprising a frame defining a window in which at least one of said indicia on the second portion is visible.

By providing indicia on the second portion, it is possible to reliably reproduce a desired tension in the strap. For example, the wearer can fit the strap to the desired tension and then can observe the indicium framed by the tensioner window at the desired tension. The wearer then knows that, in order to recreate the desired tension, they can set the strap so that the same indicium is framed by the tensioner window.

The indicia may be visible and or tactile indicia. The indicia may be numerical indicia.

Preferably, the strap includes an indicator which helps to accurately position the desired indicium in the tensioner window. The indicator may be provided on the tensioner (e.g. the tensioner side arms and/or the tensioner attachment portion) or on the first portion of the strap adjacent the tensioner. It may be raised from, recessed into or printed onto the surface of the tensioner and/or first portion. By providing an indicator, the wearer can more accurately determine the required location of the desired indicium in the tensioner window.

The indicator may be a linear or arrow-shaped element. This increases the accuracy of the determination of the required location of the desired indicium even further since the linear element or apex of the arrow-shaped element can be used to indicate a precise location for reading the desired indicium at the desired strap tension and also provides a precise location for positioning the desired indicium to re-create the desired strap tension.

The window is preferably defined by the side arms, the teeth and the attachment portion.

In preferred embodiments, the tensioner comprises two arms extending from the attachment portion and the ends of the arms distal the attachment portion each comprise a tooth. The teeth, which may also be referred to as a first cross bar, define an opening distal the attachment portion. In these embodiments, the frame defining the window comprises the attachment portion, the arms and the teeth.

Preferably, the tensioner comprises a lower surface which, in use, faces the wearer's body, and an opposing upper surface, the teeth being closer to the upper surface of the tensioner than the lower surface. The tensioner further comprises second and third cross bars extending between the arms and the second cross bar which is farthest from the attachment portion is closer to the lower surface of the tensioner than the upper surface.

This arrangement is provided to help minimise the profile of the tensioner (e.g. when the strap is a head strap to reduce discomfort when a tight-fitting hat/cap is worn and to reduce frictional resistance). In use, the second portion of the strap rests as a double layer against the teeth and the second cross bar farthest from the attachment portion (whereas the second portion loops around the third cross bar proximal the attachment portion so that only a single layer rests on each side of the third cross bar). The off-setting of the second cross bar and the teeth helps to reduce any protrusion of the double layered second portion beyond the surfaces of the tensioner. The double layer of the second portion passes over the second cross bar so positioning of the second cross bar away from the upper surface helps to provide space in which the double layer can sit without protruding above the upper surface. The double layer of the second portion passes under the teeth so positioning of the teeth away from the lower surface (e.g. flush with the upper surface) helps to provide space in which the double layer can sit without protruding below the lower surface.

The third cross bar proximal the attachment portion can be located midway between the upper and lower surfaces of the tensioner but preferably is off-set slightly towards the upper surface. This helps to facilitate insertion of the second portion into the tensioner.

Preferably, the strap is a head strap for eyewear, the tensioner having a lower surface which, in use, faces the wearer's head.

In preferred embodiments, the upper and lower surfaces of the tensioner are curved surfaces. Preferably they are curved into parallel cylindrical surfaces. The radius of curvature is preferably 65-90 mm. More preferably, the radius of curvature is between 75-90 mm and most preferably between 84-88 mm. The radius of curvature is preferably selected so that it matches the curve of the rear of the average male $95^{th}$ percentile head. In this case, the radius of curvature is about 86 mm.

By providing curved convex upper and lower tensioner surfaces (which equates to providing a curved tensioner), it is possible to fit the tensioner to the wearer's body. Fitting a head strap tensioner to a wearer's head minimises discomfort should the wearer chose to wear a tight fitting hat or cap over the head strap. The curved tensioner also helps to reduce water resistance when used on swimming goggles because the tensioner does not protrude from the wearer's head.

Preferably the tensioner is formed of plastics material such as polycarbonate.

In preferred embodiments, the tensioner attachment portion comprises a tab having at least one rib extending across the width of the tab, the at least one rib having a greater width and/or depth than the tab. Preferably, the attachment portion comprises at least two ribs. More preferably, said tab further comprises at least one aperture.

The tab, rib(s) and apertures are provided to assist in attachment of the tensioner to the tensioner end of the strap. Preferably, the strap is formed of plastic material e.g. silicone which is molded (e.g. injection molded or compression molded) around the attachment portion. By providing the rib(s) and optionally, the aperture(s), it is possible to ensure a firm bond between the molded plastic material and the attachment portion.

In some preferred embodiments, the second portion comprises a clip end, the clip end including and terminating at a clip. In use, the second portion passes through the tensioner and the clip is releasably securable onto the second portion.

By providing a strap having two ends which terminate at a tensioner and a clip, the clip being releaseably securable to the second portion after the second portion has passed through the tensioner, any free ends which could flap around and cause discomfort and distraction are eliminated.

Preferably, the clip is releaseably securable onto and moveable (e.g. by sliding) along the second portion. This allows any slack in the second portion between the tensioner and the clip end to be eliminated, again decreasing the possibility of discomfort and distraction.

Preferably, the clip comprises a pair of jaws defining a channel and an opening, the second portion of the strap being insertable into said channel through said opening to releasably secure the clip onto the second portion. The channel preferably has a cross section (e.g. a rectangular cross section) with a major dimension and a minor dimension, the major dimension of the cross-section substantially matching the width of the second section. This ensures a snug fit of the second portion in the channel which prevents inadvertent movement of the clip along the second portion.

Preferably, the minor side of the clip defining the minor dimension is small enough such that the minor side of the clip can pass through the tensioner between the side arms and between the two cross bars. Conversely, the major side of the clip defining the major dimension (which must at least match the width of the second portion of the strap) is, typically, larger than the distance between the tensioner side arms and cross bars so that the clip cannot pass through when the major side of the clip is presented. This arrangement allows the width of the tensioner (in the direction of the cross bars) to be reduced (which helps to reduce frictional drag and increase comfort for the wearer). The tensioner need only have a width sufficient to allow passage of the minor side of the clip and not the major side.

Preferably, the clip is formed of plastics material such as polycarbonate.

In preferred embodiments, the clip comprises a clip attachment portion having a tab with at least one rib extending across the width of the tab, the at least one rib having a greater width than the tab. More preferably, said tab further comprises at least one aperture.

The tab, rib and apertures are provided to assist in attachment of the clip to the clip end of the strap. Preferably, the strap is formed of plastic material e.g. silicone which is molded (e.g. injection molded or compression molded) around the clip attachment portion. By providing the rib and optionally, the aperture(s), it is possible to ensure a firm bond between the molded plastic material and the clip attachment portion.

Preferably, the strap is a head strap for eyewear and the first portion of the head strap has a first eyewear connection end opposite the tensioner end and the second portion of the head strap has a second eyewear connection end opposite the clip end. Most preferably, the first and second eyewear connection ends are connected to each other via a connection portion which, in use, passes round the rear of the wearer's head such that, in use, the first portion, second portion and connection portions form a double loop around the rear of the wearer's head. In this case, the present invention provides a one-piece double loop strap with integral tensioner and clip.

Preferably, the strap is a head strap is for sports eye wear such as a mask (e.g. for diving or skiing) or goggles (e.g. for swimming). Double loop straps (as described above) are especially desirable especially for sports eyewear used in competitive events such as swimming goggles.

Preferred embodiments of the present invention will now be described with reference to the accompanying figures in which:

DETAILED DESCRIPTION OF THE INVENTION

Figure 1:
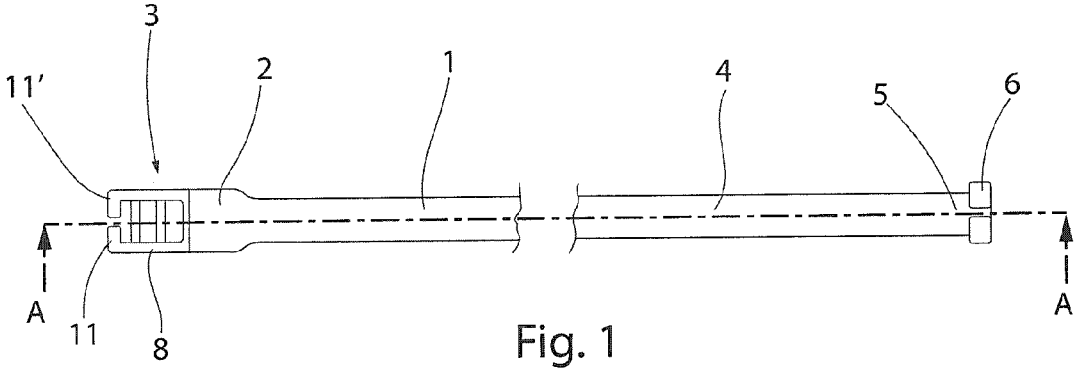
FIG. 1 shows a top view of a first preferred embodiment.
Figure 2:
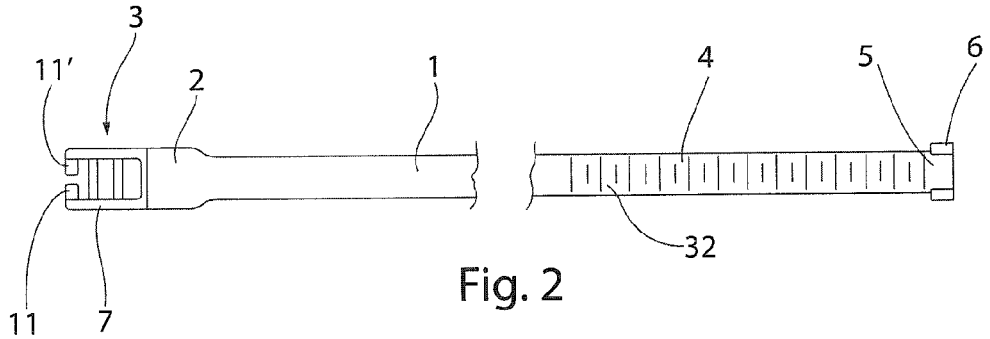
FIG. 2 shows a bottom view of the first preferred embodiment of the present invention.

FIGS. 1, 2, 3 and 4 show a top, bottom, longitudinal cross section and side view of a head strap for swimming goggles. The head strap comprises a first portion 1 having a tensioner end 2. The tensioner end 2 includes and terminates at a tensioner 3 which is shown in more detail in FIGS. 5*a*, 5*b*, 6*a* and 6*b*. The head strap further comprises a second portion 4 which comprises a clip end 5. The clip end includes and terminates at a clip 6 which is shown in more detail in FIGS. 7*a*, 7*b*, 8*a* and 8*b*. The first and second portions 1, 4 are joined to one another via a connection portion (not shown). In use, the second portion 4 passes through the tensioner 3, and the clip 6 is releasably securable onto the second portion 4 as described below.

Figure 5A:
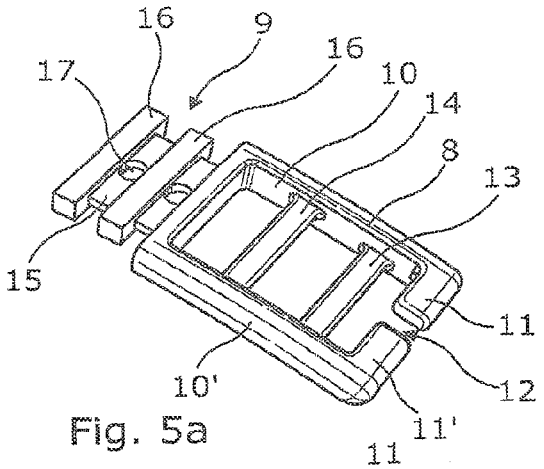
FIGS. 5*a* and 5*b* show top and bottom elevational views respectively of a tensioner.
Figure 5B:
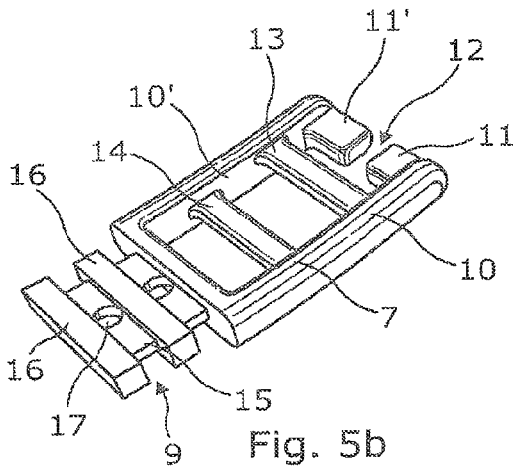

FIGS. 5*a/b* and 6*a/b* show a polycarbonate tensioner which is useful in the present invention. It has a lower surface 7 which, in use, faces the wearer's head and an opposing upper surface 8. It also includes an attachment portion 9 for attachment to the tensioner end 2.

The upper and lower surfaces 7, 8 of the tensioner 3 are curved into parallel, cylindrical surfaces having a radius of curvature around 86 mm. The radius of curvature is selected so that it matches the curve of the rear of the average male 95th percentile head. This curved profile improves the fitting of the tensioner to the wearer's head so that discomfort is minimised should the wearer chose to wear a tight fitting hat or cap over the head strap.

The tensioner comprises a frame formed of two arms 10, 10' extending from the attachment portion 9. The ends of the arms distal the attachment portion each comprise a first cross bar, also referred to as a tooth, formed by separate teeth 11, 11'. The teeth define an opening 12 distal the attachment portion 9. The teeth 11, 11' are closer to the upper surface 8 of the tensioner 3 than the lower surface 7. The tensioner further comprises two cross bars, 13, 14 extending between the arms 10, 10'. The cross bar 13 which is distal the attachment portion 9 is closer to the lower surface 7 of the tensioner 3 than the upper surface 8. The cross bar 14 proximal the 5 attachment portion 9 can be located midway between the upper and lower surfaces 7, 8 of the tensioner but preferably is off-set slightly towards the upper surface 8. This arrangement helps minimise the profile of the tensioner when the second portion has been passed through it as described below.

Figure 3:
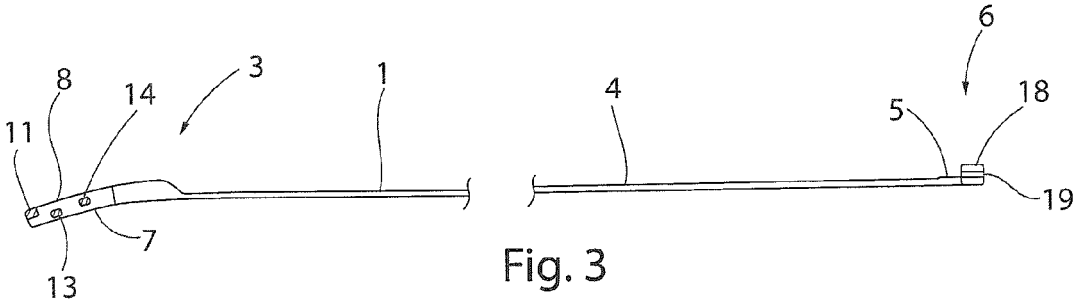
FIG. 3 shows a longitudinal cross section along line A-A of FIG. 1.
Figure 4:
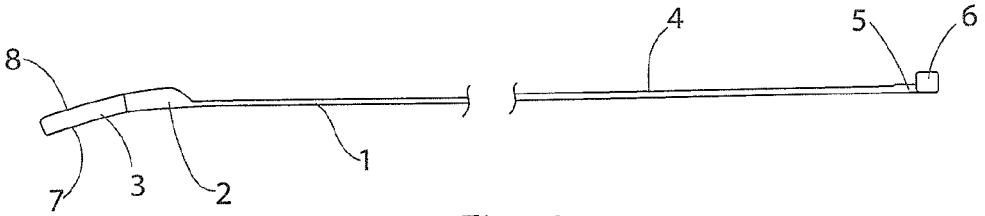
FIG. 4 shows a side view of the first preferred embodiment.
Figure 6A:
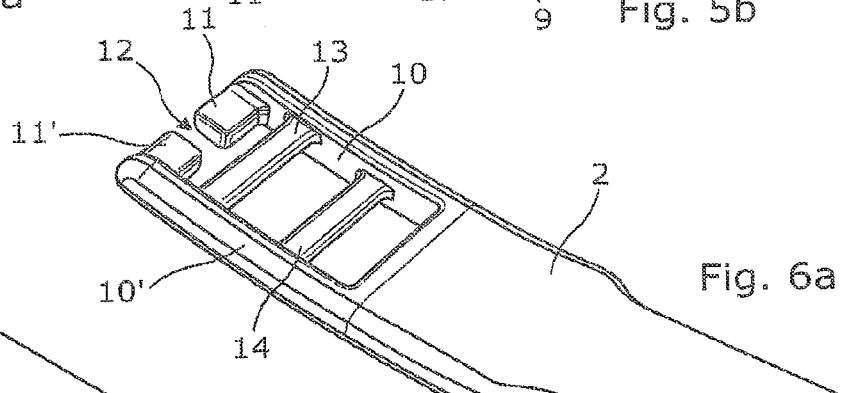
FIGS. 6*a* and 6*b* show bottom and top elevational views respectively of the tensioner end of the first embodiment.
Figure 6B:
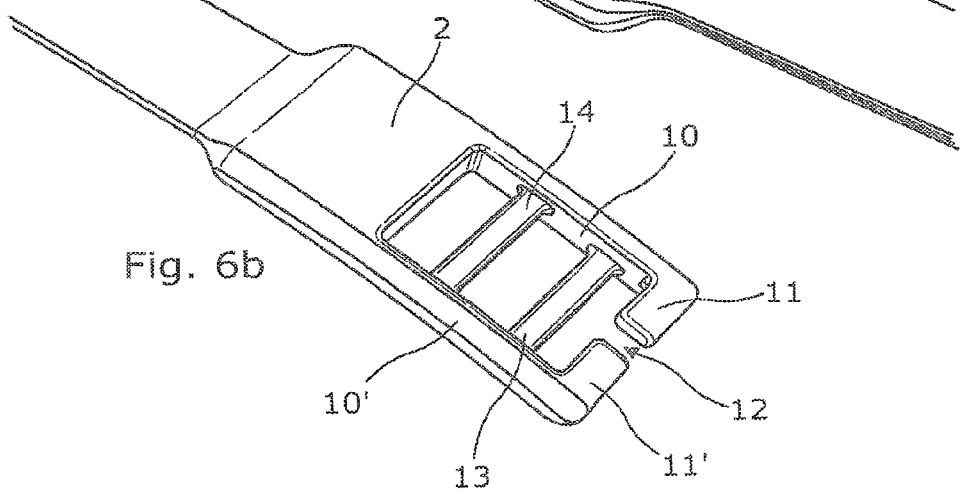

The tensioner attachment portion 9 (shown in FIGS. 5*a* and 5*b*) comprises a tab 15 having two ribs 16 extending across the width of the tab 15. The ribs have a greater width and depth than the tab 15. The tab also comprises two apertures 17. The tab 15, ribs 16 and apertures 17 are provided to assist in attachment of the tensioner 3 to the tensioner end 2 of the head strap. The head strap is formed of plastic material e.g. silicone which is molded (e.g. injection molded or compression molded) around the attachment portion 9 as shown in FIGS. 6*a* and 6*b*. By providing the ribs and apertures, it is possible to ensure a firm bond between the molded plastic material of the tensioner end 2 and the attachment portion 9. FIG. 3 shows how the cross bars 13, 14 are embedded within the plastics material forming the tensioner end 2.

Figure 7A:
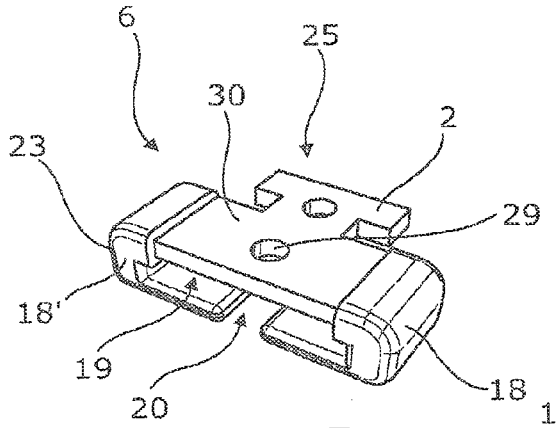
FIGS. 7*a* and 7*b* show bottom and top elevational views respectively of a clip.
Figure 7B:
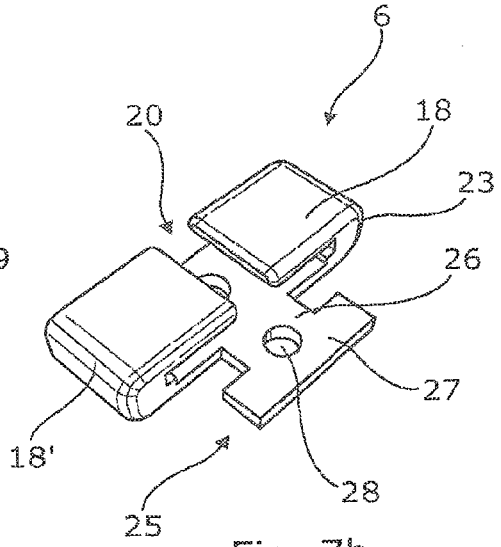
Figure 8A:
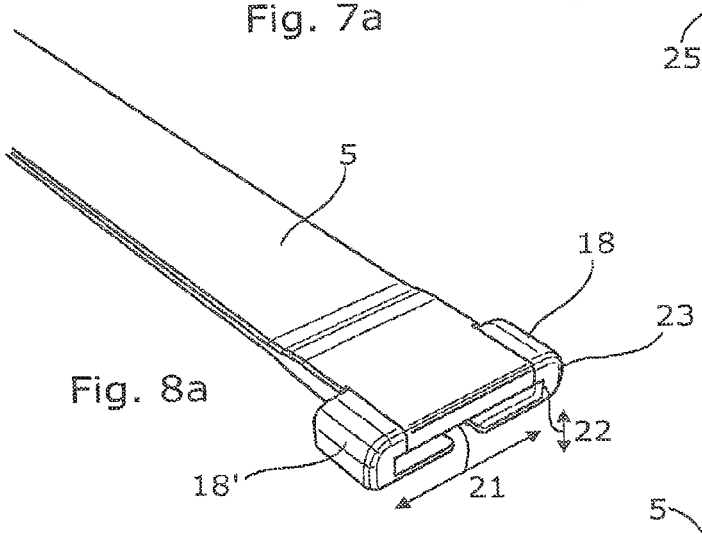
FIGS. 8*a* and 8*b* show bottom and top elevational views respectively of the clip end of the first embodiment.
Figure 8B:
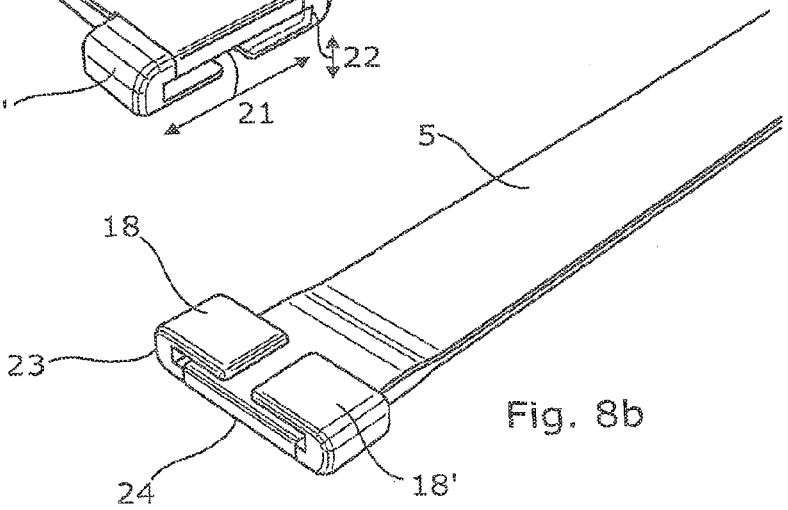

FIGS. 7*a/b* and 8*a/b* show a polycarbonate clip 6 which is useful in the present invention. The clip 6 comprises a pair of jaws 18, 18' defining a channel 19 and an opening 20. The second portion 4 of the head strap is insertable into the channel 19 through the opening 20 to releasably secure the clip 6 onto the second portion 4. The channel has a rectangular cross section with a major dimension 21 and a minor dimension 22, the major dimension 21 of the cross-section substantially matching the width of the second section. This ensures a snug fit of the second portion in the channel which prevents inadvertent movement of the clip along the second portion.

The minor side 23 of the clip 6 defining the minor dimension 22 is small enough such that the minor side of the clip can pass through the tensioner 3 between the side arms 10, 10', between the two cross bars 13, 14 and between the cross bar 14 proximal the attachment portion and the attachment portion 9. Conversely, the major side 24 of the clip 6 defining the major dimension 21 (which must at least match the width of the second portion 4 of the head strap) is, typically, larger than the distance between the tensioner side arms 10, 10', cross bars 13, 14 and cross bar 14 and the attachment portion so that the clip 6 cannot pass through when the major side of the clip is presented. This arrangement allows the width of the tensioner (in the direction of the cross bars) to be reduced (which helps to reduce frictional drag and increase comfort for the wearer. The tensioner needs only have a width sufficient to allow passage of the minor side of the clip and not the major side.

The clip comprises an attachment portion 25 having a tab 26 with a rib 27 extending across the width of the tab, the rib having a greater width than the tab. The tab further comprises an aperture 28 and another aperture 29 is provided on a recessed portion 30 of the clip.

The tab, rib and apertures are provided to assist in attachment of the clip 6 to the clip end 5 of the head strap. The head strap is formed of plastic material e.g. silicone which is molded (e.g. injection molded or compression molded) around the clip attachment portion 25 and the recessed portion 30 of the clip. By providing the rib and apertures, it is possible to ensure a firm bond between the molded plastic material and the clip 6.

Figure 9:
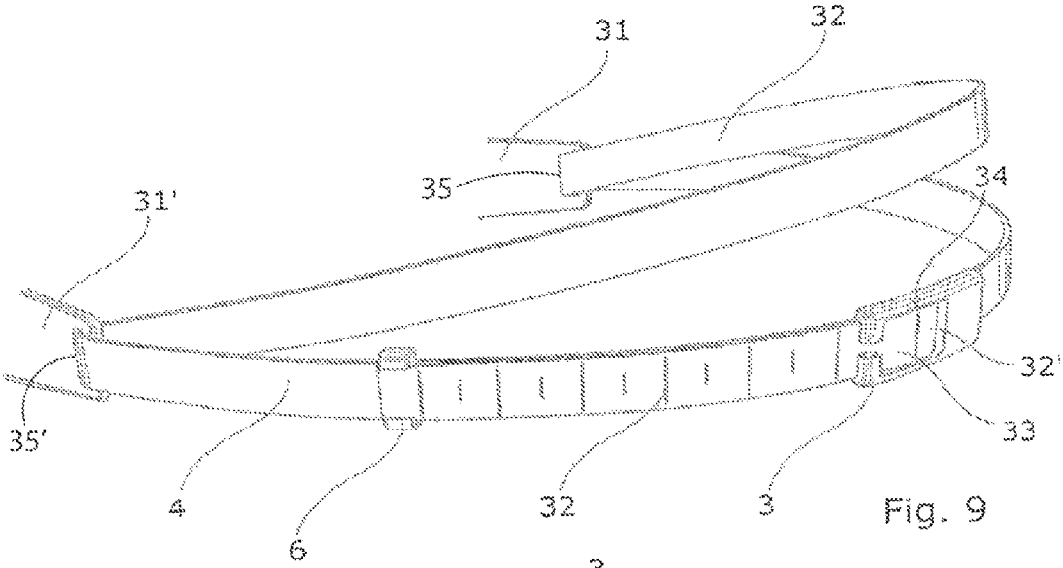
FIG. 9 shows the first embodiment assembled with goggle head strap supports.

In use, the head strap is initially connected to swimming goggles by passing the clip 6 and the clip end 5 through an aperture provided in a first head strap support 31 followed by an aperture provided in a second head strap support 31', forming connection ends 35 and 35'. These apertures are dimensioned to only receive the minor side 23 of the clip 6 in order to minimize dimensional height of the head strap supports 31, 31'. Passing the clip 6 and clip end 5 through the head strap support apertures results in a loop 32 of strap (the connection portion) extending between the two head strap supports 31, 31' as shown in FIG. 9. The tensioner end 2 of the strap remains to one side of the first head strap support 31 and the dip end 5 of the strap to the opposite side of the second head strap support 31'.

The following steps are then carried out:

1) The clip 6 and clip end 5 are then passed through the tensioner 3 between the teeth 11, 11' and the cross bar 13 distal from the attachment portion. The clip is passed through from the lower surface 7 towards the upper surface 8 on its side as only the minor side 23 can fit between the teeth and cross bar.

2) The clip 6 and clip end 5 are then passed through the tensioner 3 between the cross bar 13 distal from the attachment portion and the cross bar 14 proximal the attachment portion. The clip is passed through from the upper surface 8 towards the lower surface 7 on its side as only the minor side 23 can fit between the cross bars.

3) The clip 6 and clip end 5 are then passed through the tensioner 3 between the cross bar 14 proximal the attachment portion and the attachment portion 9. The clip is passed through from the lower surface 7 towards the upper surface 8 on its side as only the minor side 23 can fit between the cross bar and the attachment portion.

4) The second portion 4 of the strap proximal the clip end 5 is then looped back over the cross bar 14 proximal the attachment portion 9 and is inserted through the opening 12 to pass under the teeth 11, 11'. This results in the clip end 5 being looped back onto the second portion 4 of the head strap as shown in FIG. 10.

Figure 10:
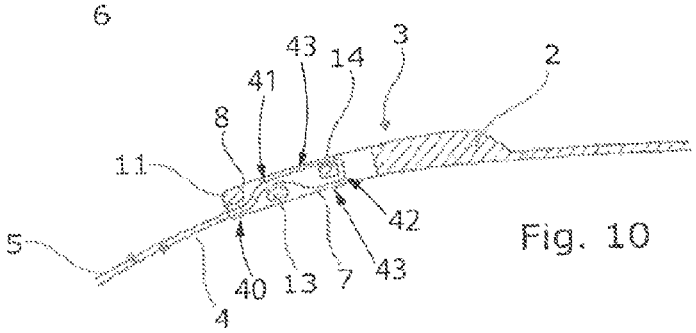
FIG. 10 shows a cross section through tensioner of the first preferred embodiment.

As shown in FIG. 10 the arrangement of the tensioner teeth 11, 11' which forms a first cross bar and the cross bars 13, 14 helps to minimise the profile of the tensioner (which reduces discomfort when a tight-fitting hat/cap is worn and reduces frictional resistance). It can be seen that the second portion 4 of the head strap rests as a double layer 40 against the teeth 11, 11' and as a double layer 41 against the cross bar 13 distal the attachment portion and the second portion 4 loops around the cross bar 14 proximal the attachment portion 9 at 42 so that only a single layer 43 rests on each side of the proximal cross bar 14. The off-setting of the cross bar 13 and the teeth 11, 11' helps to reduce any protrusion of the double layered second portion 4 beyond the surfaces 7, 8 of the tensioner 3. The double layer 41 of the second portion 4 passes over the cross bar 13 so that positioning of the cross bar 13 away from the upper surface 8 helps to provide space in which the double layer 41 can sit without protruding above the upper surface 8. The double layer 40 of the second portion 4 passes under the teeth 11, 11' so that positioning of the teeth away from the lower surface 7 helps to provide space in which the double layer 40 can sit without protruding below the lower surface 7.

As can be seen in FIG. 9, the clip is secured onto the second portion 4 remote from the clip end by inserting the second portion 4 into the channel 19 through the opening 20.

By providing a head strap having two ends which terminate at a tensioner 3 and a clip 6, the clip 6 being releaseably securable to the second portion 4 after the second portion has passed through the tensioner 3, any free ends which could flap around and cause discomfort and distraction are eliminated.

The clip 6 is releaseably securable onto and moveable by sliding along the second portion 4. This allows any slack in the second portion 4 between the tensioner 3 and the clip end 5 to be eliminated, again decreasing the possibility of discomfort and distraction. This movement is also desirable to help adjustment of the tension of the head strap as explained below.

The second portion 4 has visible indicia 32 provided along at least a part of its length on the underside. The tensioner 3 includes a window 33 in which at least one of said indicia 32 on the second portion 4 is visible when the head strap is in use. The window is defined by the side arms 10, 10', the teeth 11, 11' and the attachment portion 9. By providing indicia 32 on second portion, it is possible to reliably reproduce a desired tension in the head strap. The wearer can fit the head strap to the desired tension and then can observe the indicium 32' framed by the tensioner window at the desired tension. The wearer then knows that, in order to recreate the desired tension, they can set the head strap so that the same indicium 32' is framed by the tensioner window 33.

The tensioner includes an indicator 34 which helps to accurately position the desired indicium 32' in the tensioner window 33. The indicator is an arrow-shaped element. It is raised from the upper surface 8 of the tensioner. By providing an indicator 34, the wearer can more accurately determine the required location of the desired indicium 32' in the tensioner window 33.

The cross bar formed by teeth 11 and 11' may be referred to as a first cross bar. The cross bars 13 and 14 may be referred to as second and third cross bars, respectively. The portion of the strap extending from the eyewear to the tensioner may be referred to as a first strap portion and the portion of the strap extending from the eyewear to the clip may be referred to as a second strap portion. The ends of the first and second strap portions at the tensioner and clip may be referred to, respectively, as the distal ends of the first and second strap portions.

The invention claimed is:

1. A strap for securing eyewear of the type worn in sports activities onto a wearer's head comprising, a first strap portion having a first eyewear connection end and having a tensioner at its other end, which tensioner has a top and a bottom, a second strap portion of a given thickness having a second eyewear connection end and having a distal end and indicia on the second strap portion near the distal end, the tensioner having a window formed by two side arms having a given height between the top and bottom of the side arms, and a first cross bar, a second cross bar closest to the first cross bar and a third cross bar on the side of the second cross bar opposite from the first cross bar, the first cross bar being closer to the top of the side arms, leaving a space beneath it of at least twice the given thickness of the second strap portion and the second cross bar being closer to the bottom of the side arms, leaving a space above it at least twice the given thickness of the second strap portion, wherein when the second strap portion is wound through the tensioner, engaging the cross bars, double thickness of the second strap portion will fit between the top and bottom of the side arms under the first cross bar and over the second cross bar.

2. A strap according to claim 1, wherein the third crossbar is located mid-way between the top and bottom of the tensioner.

3. A strap according to claim 2, wherein the second strap portion is wound under the first cross bar, over the second cross bar and under and around the third cross bar, then in the reverse direction over the second cross bar and under the first cross bar and out of the tensioner in the opposite direction from which it entered, lying against the entering second strap portion.

4. A strap according to claim 3, wherein the return portion of the wound second strap portion between the third cross bar and the first cross bar is closest to the top of the tensioner where it is visible through the window.

5. A strap according to claim 1, wherein the second strap portion between the third cross bar and the first cross bar is closest to the top of the tensioner and visible through the window.

6. A strap according to claim 1, wherein the indicia comprises numerical indicia.

7. A strap according to claim 1, wherein the strap includes an indicator for indicating a position for a desired indicium in the tensioner window.

8. A strap according to claim 7, wherein the indicator is provided on the tensioner.

9. A strap according to claim 7, wherein the indicator is a linear or arrow shaped element.

10. A strap according to claim 1 wherein the tensioner has a bottom which faces the wearers body and an opposite top, the top and bottom being convex and concave, respectively, and having the same radius of curvature.

11. A strap according to claim 1 wherein the indicia on the on the second strap portion are observable through the window when the second strap portion is wound through the tensioner.

12. A strap according to claim 1 wherein the first strap portion is connected to the tensioner by an attachment portion comprising a tale having at least one rib extending across the width of the tab, the at least one rib having a greater width and/or depth than the tab.

13. A strap according to claim 1, wherein the distal end of he second strap portion is connected to a clip.

14. A strap according to claim 13, including an attachment portion connecting the distal end of the second strap portion to the clip and comprising a tab having at least one rib extending across the width of the tab, the at least one rib having a greater width and/or depth than the tab.

15. A strap according to claim 1, wherein the first cross bar is in the form of two teeth extending toward each other from the two side arms, with an opening between them.

* * * * *